United States Patent [19]

Takashima

[11] Patent Number: 4,853,681

[45] Date of Patent: Aug. 1, 1989

[54] IMAGE FRAME COMPOSING CIRCUIT UTILIZING COLOR LOOK-UP TABLE

[75] Inventor: Shigekazu Takashima, Fukaya, Japan

[73] Assignee: Kabushiki Kaisha Toshiba, Kawasaki, Japan

[21] Appl. No.: 72,227

[22] Filed: Jul. 10, 1987

[30] Foreign Application Priority Data

Jul. 17, 1986 [JP] Japan ..... 61-166640
Sep. 29, 1986 [JP] Japan ..... 61-228243

[51] Int. Cl.[4] ..... G09G 1/28
[52] U.S. Cl. ..... 340/703; 340/747
[58] Field of Search ..... 340/703, 747, 720, 793, 340/701

[56] References Cited

U.S. PATENT DOCUMENTS 4,509,043 4/1985 Mossaides ..... 340/793
4,570,233 2/1986 Yan et al. ..... 340/747
4,727,365 2/1988 Bunker et al. ..... 340/747

FOREIGN PATENT DOCUMENTS 2855731 12/1977 Fed. Rep. of Germany .
3421725 6/1983 Fed. Rep. of Germany .
60-205582 10/1985 Japan .

OTHER PUBLICATIONS

Videotex Communications Network Service (section: Terminal) Shadan-Hojin Denkitsushin-Kyokai issued on Aug. 25, 1984, pp. 209-218 in CAPTAIN PLPS of the Videotex Standards.

*Primary Examiner*—Gerald L. Brigance
*Assistant Examiner*—Richard Hjerpe
*Attorney, Agent, or Firm*—Cushman, Darby & Cushman

[57] ABSTRACT

A transparency designation memory is provided in parallel with color loop-up tables (CLUTs) corresponding to a plurality of frames. When color value data are set in the CLUTs, a transparency designation memory section detects if the color value is transparency or not, and writes data indicating the presence or absence of transparency designation. A frame selector is also provided, which selects a displayed image frame according to the transparency designation signal outputs stored corresponding to entry addresses and in the order of display priorities of the image frames. In addition, an entry address selector is provided, for supplying only the entry addresses of the frame selected by the frame select signal to an address line connected to the address terminals of the CLUTs corresponding to the frames.

6 Claims, 9 Drawing Sheets

FIG. 2
(PRIOR ART)

| ENTRY ADDRESS (RI.B.G.R) | | COLOR VALUE | | | NOMINAL COLOR |
|---|---|---|---|---|---|
| | | B | G | R | |
| 0 | 0 0 0 0 | 0 0 0 1 | 0 0 0 1 | 0 0 0 1 | BLACK |
| 1 | 0 0 0 1 | 0 0 0 0 | 0 0 0 0 | 1 1 1 1 | RED |
| 2 | 0 0 1 0 | 0 0 0 0 | 1 1 1 1 | 0 0 0 0 | GREEN |
| 3 | 0 0 1 1 | 0 0 0 0 | 1 1 1 1 | 1 1 1 1 | YELLOW |
| 4 | 0 1 0 0 | 1 1 1 1 | 0 0 0 0 | 0 0 0 0 | BLUE |
| 5 | 0 1 0 1 | 1 1 1 1 | 0 0 0 0 | 1 1 1 1 | MAGENTA |
| 6 | 0 1 1 0 | 1 1 1 1 | 1 1 1 1 | 0 0 0 0 | CYAN |
| 7 | 0 1 1 1 | 1 1 1 1 | 1 1 1 1 | 1 1 1 1 | WHITE |
| 8 | 1 0 0 0 | 0 0 0 0 | 0 0 0 0 | 0 0 0 0 | TRANSPARENCY |
| 9 | 1 0 0 1 | 0 0 0 0 | 0 0 0 0 | 0 1 1 1 | RED(HALF-LUMINANCE) |
| 10 | 1 0 1 0 | 0 0 0 0 | 0 1 1 1 | 0 0 0 0 | GREEN(HALF-LUMINANCE) |
| 11 | 1 0 1 1 | 0 0 0 0 | 0 1 1 1 | 0 1 1 1 | YELLOW(HALF-LUMINANCE) |
| 12 | 1 1 0 0 | 0 1 1 1 | 0 0 0 0 | 0 0 0 0 | BLUE(HALF-LUMINANCE) |
| 13 | 1 1 0 1 | 0 1 1 1 | 0 0 0 0 | 0 1 1 1 | MAGENTA(HALF-LUMINANCE) |
| 14 | 1 1 1 0 | 0 1 1 1 | 0 1 1 1 | 0 0 0 0 | CYAN(HALF-LUMINANCE) |
| 15 | 1 1 1 1 | 0 1 1 1 | 0 1 1 1 | 0 1 1 1 | GRAY |

IMAGE FRAME COMPOSING CIRCUIT UTILIZING COLOR LOOK-UP TABLE

BACKGROUND OF THE INVENTION

This invention relates to an image frame composing circuit utilizing a color look-up table, in which a plurality of image frames are superposed in the order of priorities already assigned to these frames, to compose a reproduced image. More particularly, this invention relates to an image composing circuit of the type in which, for image frame superposition, "transparency" is assigned to color values, which are represented by three primary color signals, R, G, and B, and the picture elements (pixels) in the image frame with lower priority are displayed in the pixel display portion where the entry address data corresponding to the "transparency" in the frame with higher priority is stored.

Some recently developed image display terminals, such as Videoteks, employ image composing systems. In one such system, the image display terminal displays a plurality of image frames, which are superposed to reproduce the original image. In another system, a color look-up table is used to increase the range of displayed colors. In yet another system, the above two systems are combined, with the disadvantage in that the construction of the video memory output section is thus more complex.

A typical example of such a combined system is a CAPTAIN PLPS (Presentation Level Protocol Syntax) system. In the image display terminal based on this system (CAPTAIN receiving adaptor), three frames are used—a code frame for storing data such as characters transmitted in the coded form, a command frame for storing graphic data which is decomposed into graphic elements and transmitted in a series of geometric commands, and a photo frame for storing graphic data which is decomposed into pixels and transmitted in the form of pattern data. These frames are priority ordered for display, the code frame, the command frame, and the photo frame, in this order. The frame with low priority appears, as "transparency" only in the portion which is color-designated in the frame with high priority. Therefore, the portion where the photo frame is displayed corresponds to the portion where the code frame and the command frame are simultaneously color-designated "transparency".

The color designation method of this system is based on the color look-up table system. In the terminal of this system, the primary color signals are not directly stored in the memory of each frame; instead, an address (called an entry address) to enable the accessing of a color look-up table (CLUT) provided for each frame is stored in the memory of each frame. The entry address of each address has a 4-bit length, and can designate 16 ($=2^4$) types of color designations. The CLUT is normally made up of a random-access memory (RAM). The intensities (Luminance) of three primary color components red (R), green (G), and blue (B) are set in each entry address. A feature of the CLUT is that when each primary color is set by 4 bits, a total of 4,096 colors ($2^4 \times 2^4 \times 2^4$) can then be set. In other words, a great number of colors can be designated. Of these colors, 16 colors are selected for each CLUT. In the case of a plurality of frames, it is necessary to designate "transparency," as described above. Usually, when R, G, and B signals as set for the CLUT are all "0", "transparency" is designated.

In the terminal which is controlled by a microprocessor (MPU), the MPU, when the power supply is turned on, sets the default value for each color, which is preset for the CLUT, in the memory address for each entry address. The default value of the CLUT is so set that when the entry address is "1000", the R, G, and B signals are all "0", viz., "transparency" is designated.

In the image composing circuit of the prior terminal, a transparency designation signal of each frame necessary for frame selection, when the image is composed, is generally obtained from a primary color signal which itself is obtained by converting the synchronized entry address, derived from each address, by means of the CLUT. Since frame selection must be performed for each display clock, the access time of the CLUT and the delay time of the transparency-detect circuit and the frame select circuit are problematic. To cope with this, the terminal uses a plurality of latch circuits to absorb the delay time and synchronize these items of data. Since the primary color signal for each frame is 4 bits long, a total of 12 bits are required for the three primary color signals R, G, and B. This results in an increase in the number of gates in the latch circuit, thereby making the circuit construction more complicated.

All of entry addresses of each frame must be simultaneously input to the CLUT of each frame. Therefore, 12-bit address lines must be wired for each frame. This results in a large number of lines.

In view of this, there is now considerable demand for a image composing circuit using the CLUT, which is more compact and has reduced wiring, but which retains the variety of colorings at present in the CLUT.

Japanese Patent Kokai No. 60-205582, which is directed to that improvement, however, loses the feature of the variety of colorings, because a single memory for the CLUT is used commonly for the respective frames.

SUMMARY OF THE INVENTION

It is therefore an object of the present invention to provide a new and improved image frame composing circuit utilizing a look-up table which can obtain a small and less-wired image composing circuit of the type in which the entry addresses from a plurality of frames are converted into primary color signals by the CLUT, and an image is composed by superposing the frames in the order of their priorities.

Another object of this invention is to provide an image composing circuit which is adaptable for the terminals having higher clock frequencies, and can reduce the delay time of the transparency detection.

According to one aspect of the present invention, an image frame composing circuit is provided, comprising:

first input means, for individually inputting the data of a plurality of image frames, the data of each frame representing entry addresses capable of causing a predetermined number of color designations including transparency designation;

second input means, for inputting color value data representing a plurality of primary color signals corresponding to the predetermined number of colors designated by the entry addresses;

a plurality of look-up table means for setting the color value data from the second input means in a predetermined address, addressable one by one, of the entry addresses from the first input means for each primary color, corresponding to the plurality of image frames;

transparency designation detect means for outputting a transparency designation signal when a predetermined value corresponding to the transparency designation is detected from the color value data from the second input means;

a plurality of transparency designation storing/read-out means for storing the transparency designation signal from the transparency designation detect means in the same address as that for the plurality of primary color signals to be set in the plurality of look-up table means, corresponding to the plurality of image frames, and for reading out the transparency designation signal stored, when the data of the plurality of image frames from the first input means correspondingly accesses an entry address corresponding to the transparency designation;

frame select means for outputting a frame select signal, to select an image frame to be displayed for each pixel, according to the transparency designation signal read out from the plurality of transparency designation storing/read-out means and the display priorities order of the plurality of image frames from the first input means;

data select means for selecting an entry address, corresponding to the image frame to be displayed, from the data of the plurality of image frames from the first input means, according to the frame select signal from the frame select means, for accessing the plurality of look-up table means by means of the entry address selected, and for activating only the look-up table means corresponding to the image frame to be displayed according to the frame select signal from the frame select means; and data composing means for composing output signals from the plurality of look-up table means for each primary color, to output a plurality of primary color signals fo the image frame to be activated and displayed.

According to another aspect of the present invention, an image frame composing circuit is provided, comprising:

first input means, for individually inputting the data of a plurality of image frames, the data of each frame representing entry addresses capable of causing a predetermined number of color designations including transparency designation;

second input means, for inputting color value data representing a plurality of primary color signals corresponding to the predetermined number of colors designated by the entry addresses;

a plurality of look-up table means for setting the color value data from the second input means in a predetermined address, addressable one by one, of the entry addresses from the first input means for each primary color, correspoonding to the plurality of image frames;

transparency designation detect means for outputting a transparency designation signal when a predetermined value corresponding to the transparency designation is detected from the color value data from the second input means;

a plurality of flip-flop means whose number is equal to the number of addresses of the plurality of look-up table means corresponding to the plurality of image frames, the transparency designation signal being set in the flip-flop means corresponding to the addresses of the plurality of primary color signals to be set in the plurality of look-up table means;

a plurality of output select means for respectively selecting an output signal from the flip-flop means in which the transparency designation signal is set, when the data of the plurality of image frames from the first input means accesses an entry address corresponding to the transparency designation;

frame select means for outputting a frame select signal, to select an image frame be displayed for each pixel, according to the transparency designation signal, such as the output signal from the plurality of output select means and the display priorities order of the plurality of image frames from the first input means;

data select means for individually accessing the plurality of look-up table means, by means of the entry address based on the data of the plurality of image frames from the first input means, and at the same time for activating only the look-up table means corresponding to the image frame to be displayed according to the frame select signal from the frame select means; and data composing means for composing output signals from the plurality of look-up table means for each primary color, and for outputting a plurality of primary color signals of the image frame, to be activated and displayed.

In one aspect of this invention, transparency designation memory means is provided in parallel with the CLUTs corresponding to a plurality of frames. When a color value is set in the CLUT, the transparency designation memory means detects if the color value is transparency or not, and writes data to indicate the presence or absence of a transparency designation signal. Also provided is a frame select means, which generates a frame select signal on the basis of a transparency designation signal, which is formed by supplying the entry address from each frame to the transparency designation signal memory means, and on the basis of a predetermined priority order. In addition an entry address select means is provided, for supplying only the entry addresses of the frame selected by the frame select signal to an address line connected to the address terminals of the CLUTs corresponding to the frames. Further, a composing means is provided, for reading out only necessary primary color signals by activating and composing only the CLUT corresponding to the selected frame.

When, in such an arrangement, the primary color signal is written into the CLUT by the MPU, the signal indicating the presence or absence of transparency designation is written, for each entry address, into the transparency designation memory means which is provided in parallel with the CLUT. Therefore, the presence or absence of transparency designation can be directly checked by referring to the entry address from each frame - not via the CLUT. Also in this case, the delay time is problematic. However, it suffices to provide a delay time-absorbing latch circuit for each entry address. Therefore, far less gates are necessary for latching circuitry than in conventional circuitry, which typically needs many gates for the respective primary color signals.

Depending on the frame select result, the entry address from the required frame is selected. The bus system is employed for transferring the selected signal to all of the CLUTs, thereby resulting in a remarkable reduction in the amount of wiring required. This reduction is achieved by way of activating only the CLUT for the selected frame, and composing the activated outputs.

Another aspect of this invention is the provision of a flip-flop group which comprises the same number of flip-flops as that of addresses of each of the color look-up tables, transparency detecting means for detecting whether or not transparency designation has been performed vis-a-vis the primary color signal set in an appropriate address of the color look-up table, transparency designation means for setting the detect output of the transparency detecting means into the flip-flop corresponding to an entry address output from the frame, and output select means for selecting a displayed frame, according to the select output from said output select means and in the order of display priorities of said frames.

When, in such an arrangement, the primary color signals are set in the color look-up table, the transparent setting, i.e. the detect output of the transparency detect means is set in the flip-flop group by the transparency setting means. When the entry address is output from the frame, the output select means selects the output of the flip-flop corresponding to the entry address. In other words, the path for writing the transparency detect output into the flip-flop group is provided separate from the path for selecting the outputs from the flip-flop group, according to an entry address from the frame, Therefore, the number of address switches required for the prior circuit using the RAM, can be reduced. Not having to use the RAM reduces the delay time for the transparency detection achieved by retrieving the entry address.

All of the aspects of this invention ensure an increase in the range of colors for display in the CLUT.

BRIEF DESCRIPTION OF THE DRAWINGS

These and other objects and features of the present invention can be understood through the following embodiments by reference to the accompanying drawings, in which:

FIG. 2 shows a table describing the relationship between the color values and the entry addresses of the color look-up table which is used in the FIG. 1 circuit;

DETAILED DESCRIPTION OF THE PREFERRED EMBODIMENTS

Figure 1:
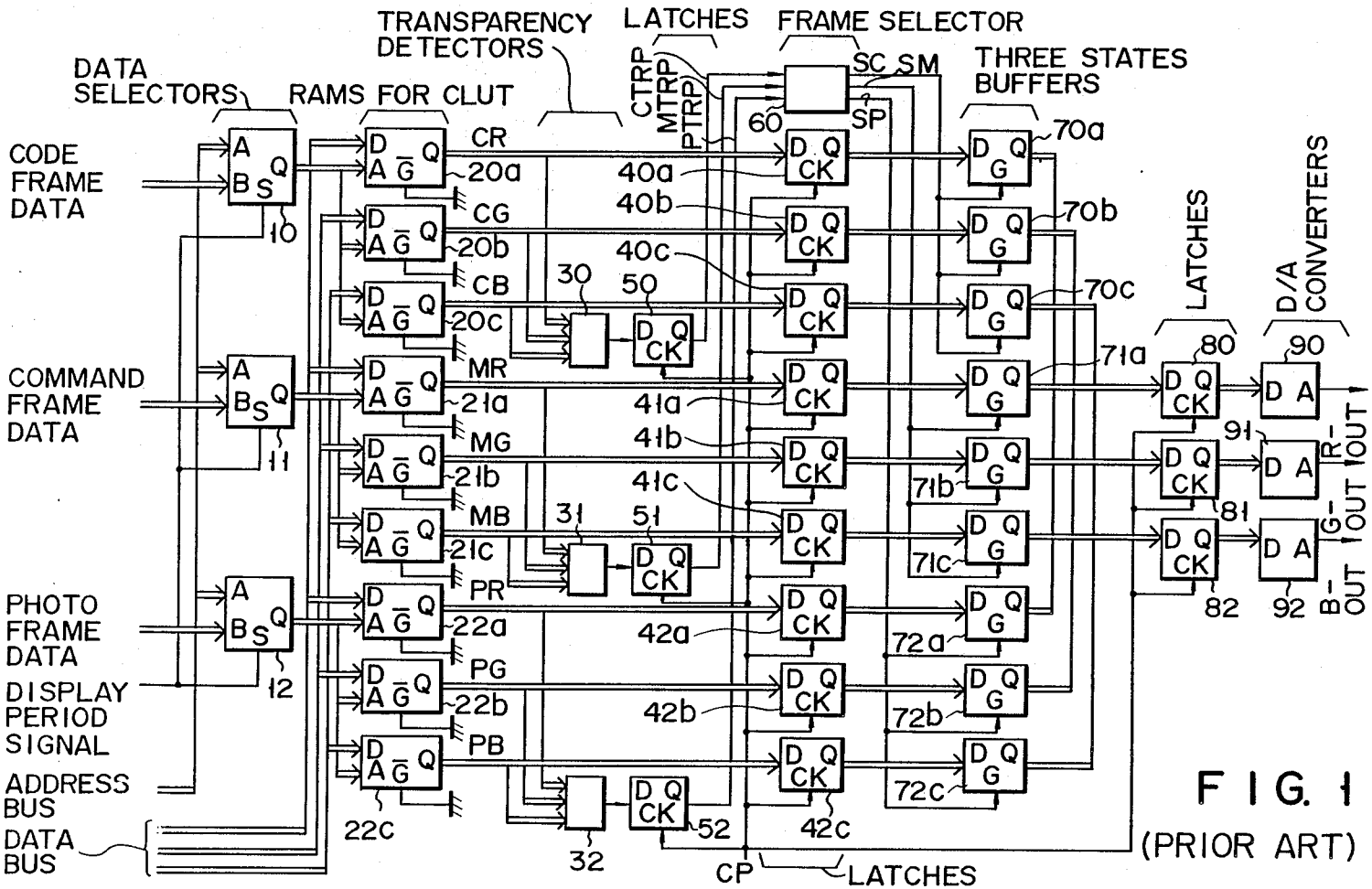
FIG. 1 (PRIOR ART)
FIG. 1 shows a block diagram illustrating a prior image frame composing circuit.

The above-mentioned prior image frame composing circuit in the terminal, will be described, referring to FIG. 1, for each of understanding.

4-bit data, i.e., an entry address, is output from each memory (not shown) of the code frame, command frame and the photo frame, which are provided in the terminal main body proper (not shown), in synchronism with the raster scanning for the CRT display (not shown). The 4-bit data are respectively input to terminals B of data selectors 10, 11 and 12. Address data of 4 bits is input commonly to the terminals A, from the MPU (not shown) via the address bus. These selectors 10 to 12 select and output the entry addresses from the respective frame memories during the CRT display period, in response to the display period signal. During the other period, selectors 10 to 12 select and output the addresses from the MPU, in order to set color values in the respective CLUTs to be described later. The Q output of data selector 10 is supplied commonly to address input terminals A of RAMs 20*a* and 20*c* as the code frame CLUT. The Q outputs of data selectors 11 and 12 are respectively supplied commonly to address input terminals A of RAMs 21*a* to 21*c* and RAMs 22*a* to 22*c* as the command frame CLUT and the photo frame CLUT. All of these RAMs 20*a–c* to 22*a–c* have each a configuration of 4 bits×16 words. R components, G components, B components are respectively set by the MPU into RAMs 20*a* to 22*a*, RAMs 20*b* to 22*b* and RAMs 20*c* to 22*c* during the CRT non-display period, as color values. The color values are assigned to colors, as shown in FIG. 2. The data of the color values are supplied via the data bus of the MPU.

4-bit outputs CR, CG and CB of CLUT RAMs 20*a* to 20*c* are supplied to transparency detector 30, and further respectively supplied to latches 40*a* to 40*c*. Similarly, the bit outputs of CLUT RAMs 21*a* to 21*c* are supplied to transparency detector 31, and further respectively to latches 41*a* to 41*c*. The bit outputs of CLUT RAMs 22*a* to 22*c* are supplied to transparency detector 32, and further respectively to latches 42*a* to 42*c*.

Transparency detectors 30 to 32 are all made up of negative logic 12-input AND gates. When the levels of the 12 inputs are all "0's", the detector detects the transparency designation, and outputs a "1" level (see FIG. 2).

The outputs of transparency detectors 30 to 32 are input to corresponding latches 50 to 52. A common latch clock, that is, the display clock CP from the MPU, is used for all the latches 40 to 42 and latches 50 to 52. The display clock CP is required for correcting the difference among the timings of the output signals of CLUT RAMs 20 to 22 and of the transparency detectors 30 to 32, which is due to signal delay. The outputs CTRP, MTRP and PTRP of latches 50 to 52 are supplied to frame selector 60. Frame selector 60 outputs one of the three types of select signals SC, SM and SP. The select signal SC is supplied commonly to output control terminals G of 3-state buffers 70*a* to 70*c*, which are respectively supplied with the outputs of latches 40*a* to 40*c*. Similarly, the select signal SM is supplied to output control terminals G of 3-state buffers 71*a* to 71*c*, which are respectively supplied with the outputs of latches 41*a* to 41*c*. The select signal SP is supplied to the output control terminals G of 3-state buffers 72*a* to 72*c*, which are respectively supplied with the outputs of latches 42*a* to 42*c*. Each of the 3-state buffers 70 to 72 goes active when the level of the output control terminal G is "1", while during the other period, the buffer is in the high-impedance state.

Frame selector 60 selects the frame to be displayed for every picture element, according to the display priority of the frames, and transparency designation signals CTRP, MTRP and PTRP from the frames, and are configured with the logic circuits which satisfy the following logic relations.

$$SC=\overline{CTRP} \quad (1)$$

$$SM=CTRP.\overline{MTRP} \quad (2)$$

$$SP=CTRP.MTRP.\overline{PTRP} \quad (3)$$

As seen from the relations, the frame of a lower display priority is displayed on the CRT display only when a frame of a higher priority is designated to be "transparency."

Figure 9:
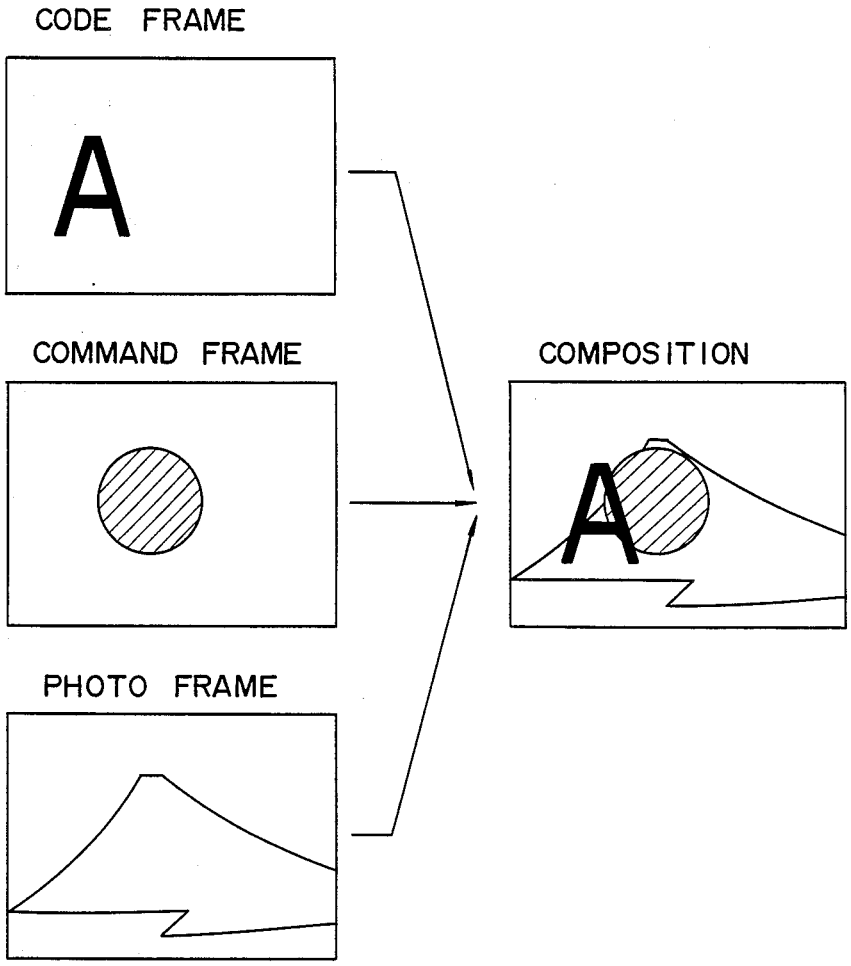
FIG. 9 shows a schematical diagram illustrating the frame composition.

The outputs of 3-states buffers 70*a* to 72*a*, 70*b* to 72*b*, and 70*c* to 72*c*, are connected in a wired OR fashion, and are respectively supplied to latches 80 to 82. Display clock CP is supplied to latches 80 to 82 as a latch pulse. Frame selector 60 decides the frame for every display clock CP, and the digital data of R, G and B components output from one of the buffer groups 70 to 72, are timed to the display clock CP from the MPU by latches 80 to 82, and input to D/A converter 90 to 92. The R, G and B outputs of analog levels are obtained from the output of D/A converter 90 to 92. The outputs are displayed n the CRT display, for example, as the frame composition of the code frame, the command frame and the photo frame, as shown in FIG. 9.

In the prior image frame composing circuit, a plurality of latches 40*a–c*, 41*a–c*, 42*a–c*, (a total of $4\times3\times3=36$ bits) are required for absorbing delay, as described above.

This circuit technique requires additional latches in the stages preceding to the frame selectors 60 and latches 40*a–c* to 42*a–c* for synchronizing the timings, unless the select time of the frame selectors 60 is extremely fast, thus increasing the circuit size.

As described above, there has been developed the Videoteks terminal. In this terminal, a plurality of image data frames are contained. The color values to be output to the CRT display are reproduced using the color look-up tables corresponding to the image data frames. "Transparency" is assigned to a specific color value, e.g., R=G=B=O. (visualizes the image data of the frame with low priority) For image displaying, a plurality of frames are superposed in the order of their priorities.

Figure 3:
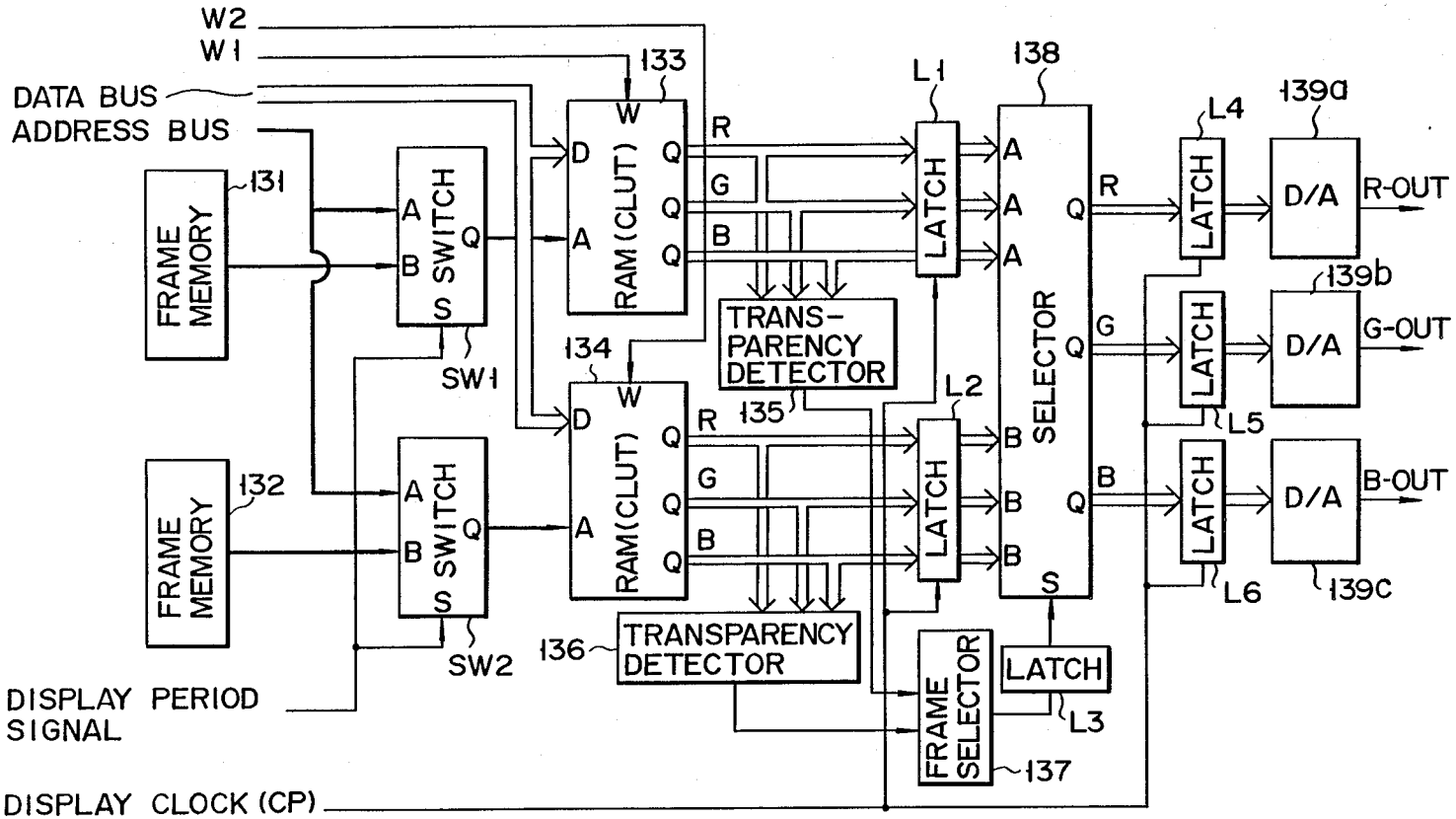
FIG. 3 (PRIOR ART)
FIG. 3 shows a block diagram of another prior art.

There is known an image frame composing circuit having a configuration shown in FIG. 3, in use for the terminal such as Videoteks which employs the above system. The data from frame memories 131 and 132 are respectively input to CLUT (color look-up table) RAM 133 and 134 via switches SW1 and SW2, as entry addresses. By the data, the color values in color look-up table RAM 133 and 134 are read out. The color values are previously set in RAM 133 and 134 by the write signals W1 and W2 from the MPU (microprocessor) which controls the terminal, and the data bus and address bus. The color values read out from the CLUTs on the basis of the entry addresses derived from frames 131 and 132 are respectively checked by transparency detectors 135 and 136, as to whether the color values represent transparency or not. The result is input top the frame selector 137, which finally determines the frame to be output by the display priorities as previously set. By the output of frame selector 137, the necessary color values of those values read out by the entry addresses from frame memories 131 and 132, is selected by selector 138. The outputs are D/A converted by D/A converters 139*a–c*, and output as primary color signals to the CRT display.

The above mentioned operation must be performed for each pixel of display, since there is a problem that each circuit portions have delay times. To solve this, latch circuit L1 to L6 using the display clock as the latch pulse are generally inserted in the signal lines. In this case, the latch circuits must be used for the color values of each frame, respectively, resulting in increasing the number of necessary latch circuits. Also in the select circuit 138 to select the color value, a large number of inputs are used, hence large circuit size is needed.

Figure 4:
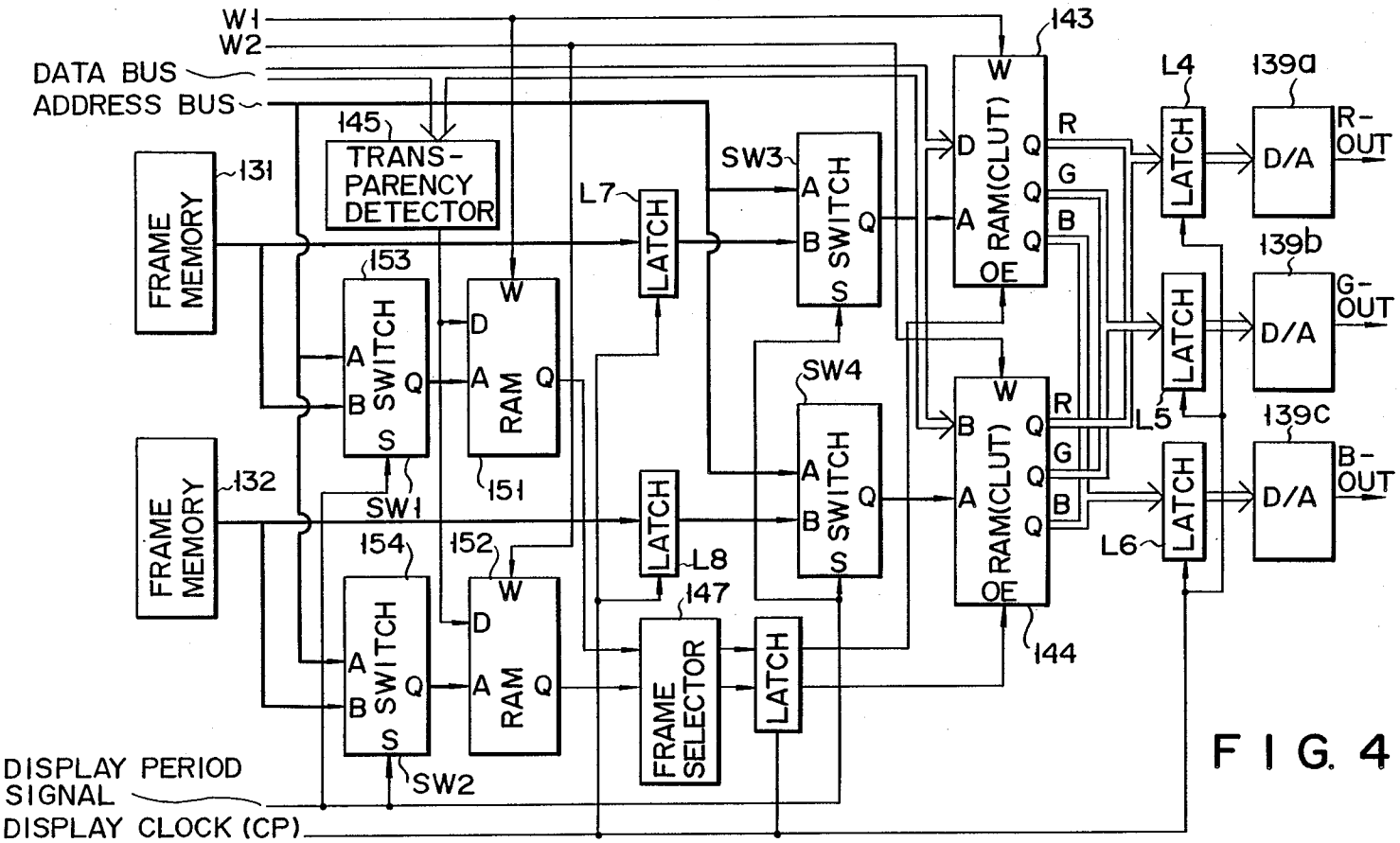
FIG. 4 shows a block diagram illustrating the technical idea on which the present invention is based, and which is the improvement of FIG. 3 circuit.

As a means for solving the above problems of the conventional circuits, the inventor(s) of the present application has already proposed the circuit shown in FIG. 4, which is the prior art of this invention. In this figure, corresponding to frame memories 131 and 132 in the terminal main body, switches 153 and 154, and switches SW3 and SW4, and transparency decision RAM 151 and 152 are provided, in addition to color look-up table RAM 143 and 144. Transparency decision RAM 151 and 152 store signals indicating whether or not the color values include transparency. The addresses of the transparency decision RAM 151 and 152 correspond to those of color look up table RAM 143 and 144. The writing of transparency decision into transparency decision RAM 151 and 152 can be performed by transparency detector 145 simultaneously when the color values are set into color look-up table RAM 143 and 144 by the MPU in the same manner as in FIG. 3.

With such a configuration, transparency decision is allowed before the color value is reproduced in each CLUT, by supplying the data from frame memories 131 and 132 via switches 153 and 154, as addresses for RAM 151 and 152. Therefore, the frame selection is also performed by frame selector 147 before the color value reproduction. With this feature, only two latches L7 and L8 for 4 bits must be provided for timing synchronization. Moreover, the color value selection is performed by controlling the output enable terminal OE of color lookup table RAM 143 and 144, and by connecting each output of RAM 143 and 144 in a wired OR fashion. Therefore, there is no need for selector 138. As a result, the circuit size is greatly reduced. The succeeding processing is the same as in the FIG. 3 circuit.

However, even in the above proposal, the outputs of transparency decision RAM 151 and 152 are used for transparency decision. Therefore, the delay from the data output from frame memories 131 and 132 until the decision of output frame is a sum of the delay in RAM address selecting switches 153 and 154, an access time of transparency decision RAM 151 and 152, and the delay in frame selector 147. As compared with the prior configuration, only the delay in transparency detector 135 and 136 is reduced. Therefore, the delay of the entire circuit is only slightly improved. Therefore, the application to a terminal with a higher display clock frequency remains problematical, and the upper limit of the display frequency not requiring timing synchronization is unacceptably low.

As described above, in the conventionasl and prior image composing circuit, provision of the latch circuits for timing synchronization in the related circuits increases the circuit size, and narrows the margins for the delay, although a variety of colors for display is ensured. Therefore, these circuits are not suitable for terminals with high display clock frequency.

Another embodiment of an image composing circuit according to this invention, which is directed to solving the just mentioned problems, will now be described.

Figure 5:
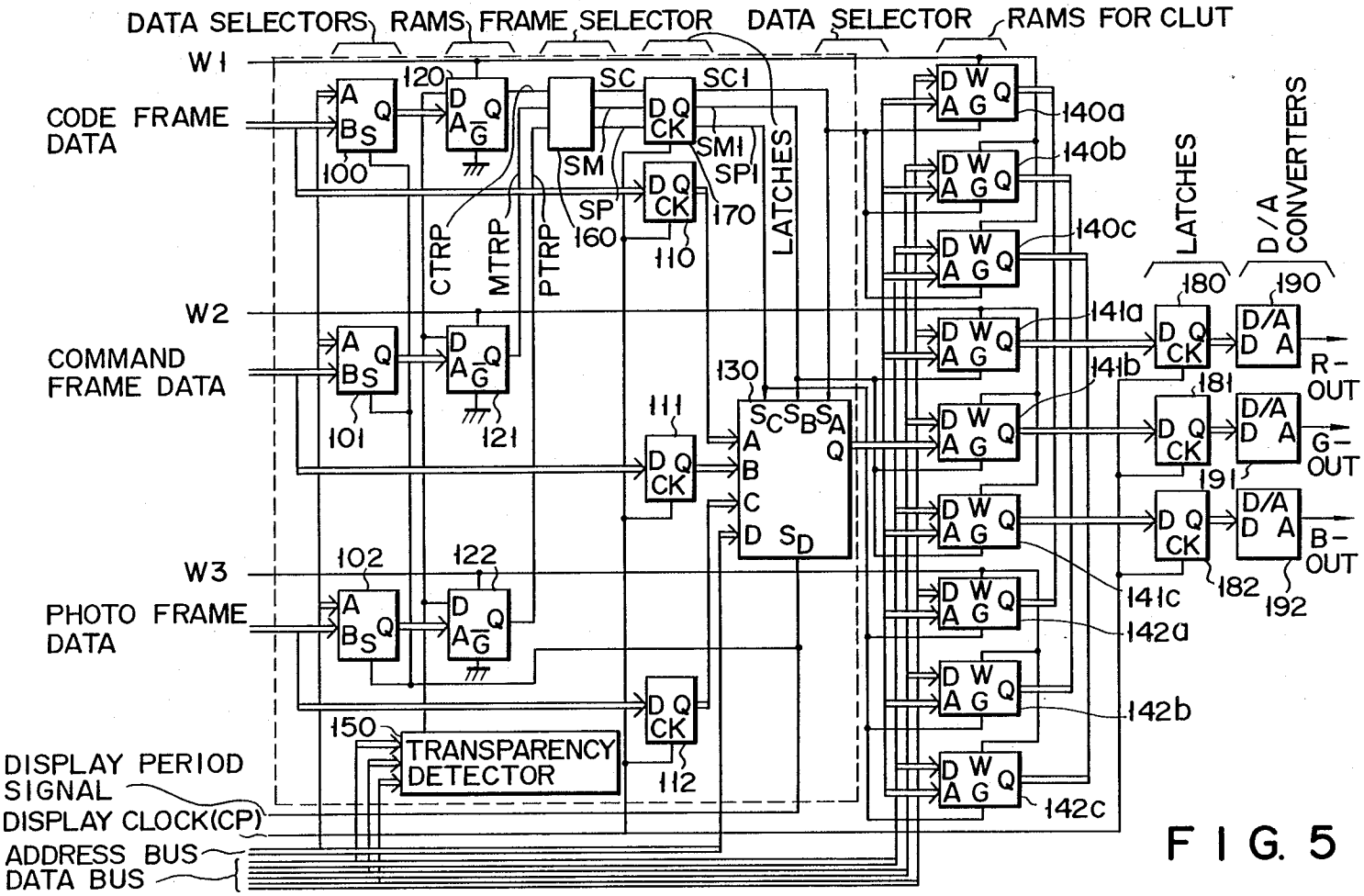
FIG. 5 shows a block diagram illustrating a first embodiment of an image frame composing circuit according to the present invention.

In FIG. 5 showing the first embodiment of the present invention, 4-bit data (i.e., the entry address) is output from respective memories (not shown) of code frames, command frame and photo frame in the terminal main body (not shown), in synchronism with the raster scanning of the CRT display. The data is input to respective terminals B of data selectors 100 to 102. The data is also input to latches 110 to 112. The address data of 4 bits is input commonly to terminals A of data selectors 100 to 102, from the address bus of the MPU (not shown) which controls the terminal. The Q outputs of data selectors 100 to 102 are respectively input to address terminals A of RAMs 120 to 122. RAMs 120 to 122 have a configuration of 1 bit×16 words. Because the display period signal from the MPU is supplied to select terminals S of data selectors 100 to 102, code frame data, command frame data and photo frame data are respectively input to address input terminals A of RAMs 120 to 122 during the display period of the CRT display. Because address data from the address bus of the MPU is supplied to address input terminals A of RAMs 120 to 122 during the other period, these RAMs 120 to 122 are put under control of the MPU during this period.

Latches 110 to 112 outputs respective input data in synchronism with display clock CP from the MPU, like latch 170, to be described later. The outputs of latches 110 to 112 are input to data selector 130, as three input data groups A to C. Data selector 130 selects one data group of four input data groups A to D. The address data from the MPU is input as the input data group D. Three output signals SC1, SM1 and and SP1 of latch 170 and the display period signal from the MPU are respectively supplied to select terminals SA to SD, which correspond to input data groups A to D.

The Q output of data selector 130 is input to the address input terminals A of RAMs 140*a* to 140*c* as the CLUT for code frame, RAMs 141*a* to 141*c* as the CLUT for command frame, and RAMs 142*a* to 142*c* as the CLUT for photo frame. The color value data in which the primary color components R, G and B are expressed in the default value in FIG. 2, is input to the data input terminal D of these RAMs 140 to 142. This data is 4 bits×3. The R component is set in RAMs 140*a* to 142*a*; The G component, in RAMs 140*b* to 142*b*; the B component, in RAMs 140*c* to 142*c*. The data of each component is made up of 4 bits×16 words. The setting of color value into these RAMs 140 to 142 is performed when write permission signals W1 to W3 corresponding to RAMs 140 to 142 are generated. The write permission signals W1 to W2 are output when RAMs 140 to 142 for CLUT are under control of MPU. It is for this reason that the address data from the MPU as the output of selector 130, is output during the non-display period of CRT display.

The transparency detector 150 is made up of a 12-input AND gate of the negative logic type. This circuit 150 produces a "1" signal for transparency designation checking only when the color values set in RAMs 140 to 142 for CLUT are all "0". The output of transparency detector 150 is applied to the data input terminals D of RAMs 120 to 122 for transparency designation. RAMs 120 to 122, like RAMs 140 to 142, allows the write of data only when write permission signals W1 to W3 corresponding to RAMs 120 to 122 are generated during the nondisplay period of CRT display. Transparency designation signals CTRP, MTRP and PTRP output from RAMs 120 to 122 for transparency designation memory during the display period of CRT display, causes frame select circuit 160 to generate one of the three select signals SC, SM and SP, which are based on the expressions (1) to (3). Select signals SC, SM and SP are latched by latch circuit 170 which uses the display clock CP from the MPU, as latch clock. Through the latching, signals SC, SM, and SP are synchronized with the entry addresses from the frames, which are input to selector 130, and are output as frame select signals SC1, SM1 and SP1. The frame select signals SC1, SM1 and SP1, synchronized with the entry addresses in this way, are input to the output control terminal G of RAMs 140 to 142 for CLUT, respectively, and also to the select terminals SA, SB and SC of selector 130. As a result, the entry address of the selected frame is supplied to all of RAMs for CLUT. Concurrently, only the output of the CLUT for the selected frame is active, while the outputs of the CLUTs of the remaining frames are left in a high impedance state. The outputs corresponding to the bits of CLUT RAMs 140 to 142 of each frame are connected in a wired OR fashion, and input to latch circuits 180 to 182 using the display clock CP from the MPU as the latch pulse. The digital data of primary color components R, G and B, are selected for each display clock CP and output from one set of RAMs 140*a* to 140*c*, 141*a* to 141*c* and 142*a* to 142*c* for CLUT. The digital data are synchronized with the display clock CP from the MPU by latch circus 180 to 182, and input to D/A converters 190 to 192. The outputs of converters 190 to 192, form the R, G, and B signals at analog levels, which are then displayed on the CRT display, as shown in FIG. 9.

Description to follow concerns how color values are set in to RAMs for CLUT 140*a* to 140*c*, 141*a* to 141*c* and 142*a* to 142*c*, and how to set the transparency designation signal to RAMs 120 to 122 for transparency designation memory.

The color value setting to the CLUT is performed during the non-display period of the CRT display when the address data from the address bus of the MPU are input to the address input terminals A of RAMS 140 to 142. This control is realized through the interrupt to the MPU. The CLUT RAMs 140 to 142 for frames are each assigned with 16 addresses. A total of 12 bits, 4 bits for each color signals R, G and B, are set, as a color value, in one address (see FIG. 2). When the MPU executes an instruction to set the color value to the address "0" of each RAM 140*a* to 140*c* for code frame CLUT, RAMs 140*a* to 140*c* are specified by the address data from the MPU, through the address decoder (not shown) of the terminal body proper. At the same time, a write permission pulse W1 is generated in response to the write pulse output from the MPU. As a result, the color value data output from the MPU to the data bus is written into the address "0" of each RAM 140*a* to 140*c*. At this time, write permission signal W1 is also input to RAM 120 for transparency designation memory. Similarly, "0" or "1" is supplied to data input terminal D, is written into the address "0". At this time, the input of transparency designation circuit 150 is the color value data to be set in the code frame CLUT. If the color value data is R=G=B="0000" for transparency designation, the output is "1", and "1" is written into the address "0" of RAM 120. On the other hand, if the color value data is not the transparency designation, "0" is written into the address "0" of RAM 120. This is correspondingly applied for the color value setting of other frames and the setting of transparency designation signal.

As described above, to set the color value to CLUT RAMs 140 to 142, decision is made as to whether the transparency value data corresponding to the entry address is for transparency designation or not. On the basis of this decision, the transparency designation signal is set in RAMs 120 to 122 for transparency designation storage. Therefore, it is possible to perform the transparency designation detection and the frame select before the CLUT is read out. This enables the connection of the latch circuits for timing synchronization in the frame selection to be performed by entry of a significantly smaller number of addresses. For this reason, the number of latch circuits is typically reduced by ⅓ that of conventional circuitry, resulting in simplification of the circuit construction.

In this embodiment, the signal address input signal line is used commonly for CLUT RAMs 140 to 142. On the basis of the frame select result, only the entry address of the necessary frame is output from data selector 130. With this, the number of wirings to CLUT RAMs 140 to 142 can greatly be reduced. When the portion enclosed by a dotted line in FIG. 5 is integrated in the circuit fabrication, the outputs to RAMs 140 to 142 for CLUT are only a total of 7 bits, three bits for frame select signals SC1, SM1, and SP1, and 4 bits of the entry address. Therefore, the number of pins for IC can be greatly reduced.

Since the frame select can be normally made using the output control terminal of the RAM, the number of output control buffers can also be reduced at the time of image composing. This leads a corresponding reduction in parts.

According to the first embodiment, the primary color signals, which are formed by converting the entry addresses of frames by the CLUT, can be processed for the image composing in the order of display priorities, with a relatively simple circuit and less wirings.

A second embodiment of an image composing circuit according to this invention will be described. In this embodiment, two types of frame memories are used for the terminal body proper (not shown). Each frame data (entry address) contains 4 bits for each pixel. The color values set in the color look-up table are primary color signals R, G and B, each consisting of 4 bits. the transparency is designated by the color value R=G=B="0000".

Figure 6:
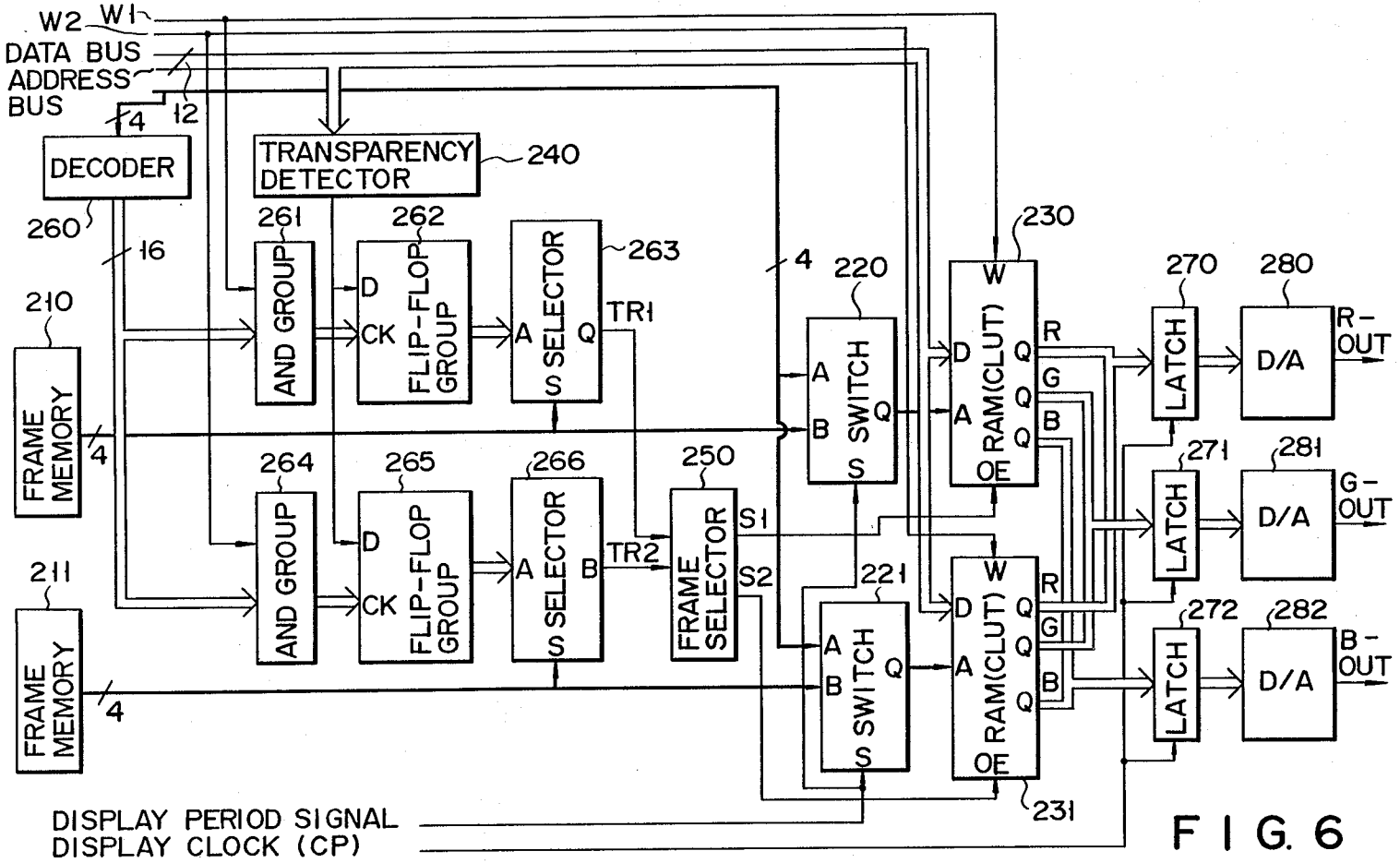
FIG. 6 shows a block diagram illustrating a second embodiment of an image frame composing circuit according to the present invention.

In FIG. 6 showing the second embodiment of this invention, the data from frame memory 210 is input to the terminal B of switch 220 and to select terminal S of selector 263. The data from frame memory 211 is input to terminal B of switch 221 and to select terminal S of selector 266. The address data of 4 bits are input to the other terminals A of switches 220 and 221 from the address but of MPU (not shown) which controls the terminal. A display period signal from the MPU is input commonly to select control terminals S of switches 220 and 221. Switches 220 and 221 respectively select the entry address data from frame memories 210 and 211 during the display period of the CRT display (not shown), and respectively select the address data from the MPU during the non-display period.

The Q output of switches 220 and 221 are respectively input to address input terminals A of color look-up table (CLUT) RAMs 230 and 231. Color value data from the data bus of the MPU is input to the data input terminals B of RAM 230 and 231. Write signals W1 and W2 generated by the MPU are respectively input to write signal input terminals W of RAMs 230 and 231. With the above configuration, color value from the MPU can be set into CLUT RAMs 230 and 231 during the non-display period, and the color values corresponding to the entry address data from frame memories 210 and 220 can be read out in the display period. The output control terminal OE is activated when the color values are actually output from the outputs Q of CLUT RAMs 230 and 231. This means that during the non-display period of the CRT display, the terminal OE is in a high-impedance state.

The outputs of RAMs 230 and 231 having the associated bits are connected in wired OR fashion, and respectively timed by latches 270 to 272 which takes display clock (CP) as a latch pulse. The outputs are converted into analog signals by D/A converters 80 to 82, and then output as the primary drive signal for the CRT display.

As described above, in this embodiment, the image is practically composed by control signals S1 and S2 which are supplied to output control terminals OE of CLUT RAMs 230 and 231. To generate a control signal S1 or S2, the display priorities of frame memories 210 and 211, and decision signals TR1 and TR2 for deciding whether the frame data is transparency or not, are required. Normally, however, the display priorities are previously decided, as described above. Therefore, only transparency decision signals TR1 and TR2 are required.

The feature of this invention resides in the transparency decision means for obtaining the transparency decision signals TR1 and TR2. The detailed description of the circuit configuration of the decision means will be given. In FIG. 6, decoder 260 and transparency detect circuit 240 form a portion of the transparency decision means necessary for respective frame memories 210 and 211. The remaining portions of the transparency decision means for frame memory 210 contain AND gate group 261, flip-flop group 262, and selector 263. Similarly, AND gate group 264, flip-flop group 265, and selector 266 are for the frame memory 211.

Figure 7:
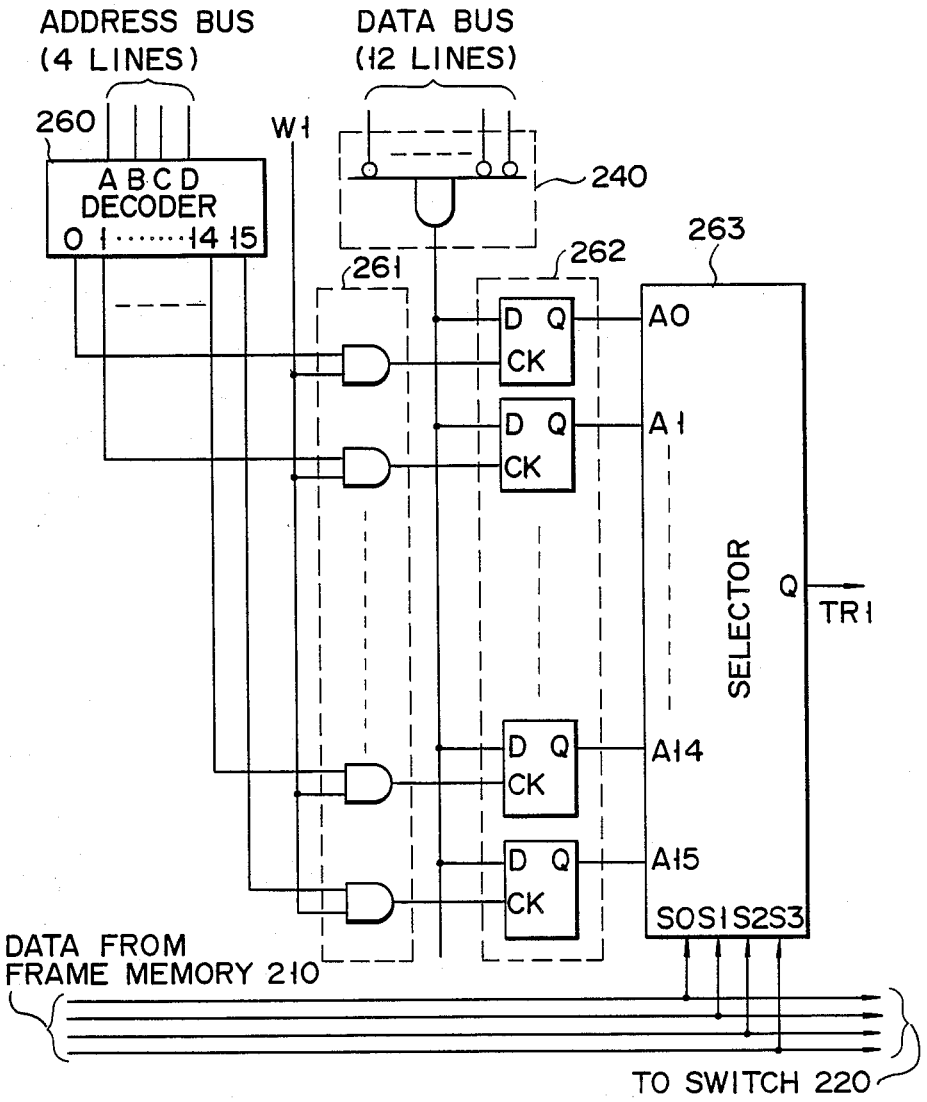
FIG. 7 shows a block diagram illustrating in details the portion of FIG. 6.
Figure 8:
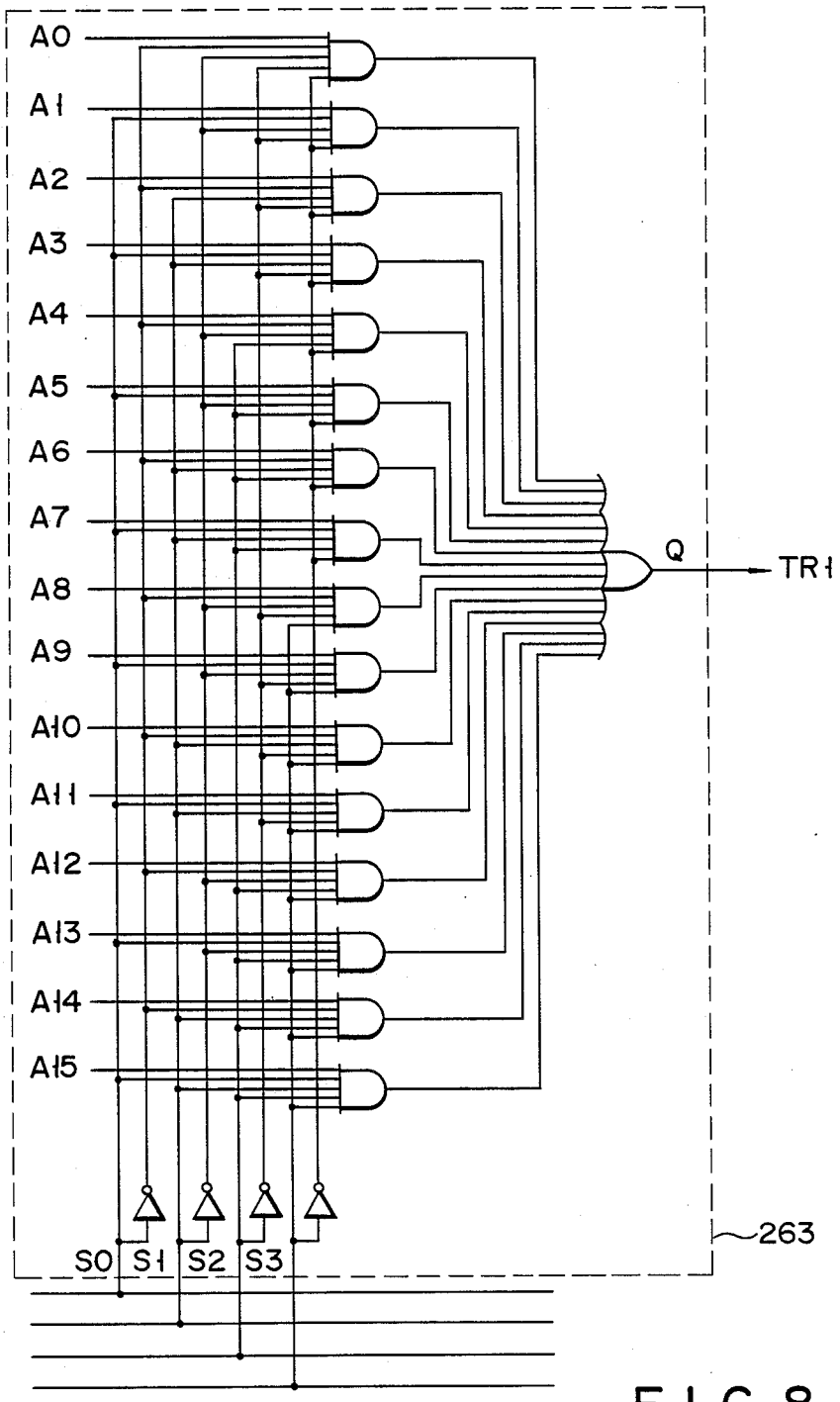
FIG. 8 shows a circuit diagram illustrating in details the selector portion of FIG. 7.

FIG. 7 shows in block form a specific circuit of the transparency circuit of the transparency decision means in frame memory 210. FIG. 8 shows a circuit diagram illustrating in detail selector 263 of FIG. 7. The operation of the transparent decision means will be described, referring to FIG. 6 to 8.

As described earlier, in the color graphic terminal having a color look-up table, the microprocessor sets predetermined color values into the respective addresses of the color look-up table at the time of power on, during the initial processing. When the terminal is in operation, the color value setting is performed by the terminal operation, or the color designating command, (clear screen and the like), contained in the received data.

The operation of the transparency decision means when the color value is written into color look-up table RAM 230, will now be described.

When the MPU (not shown) writes the color value to the address n (n=0 to 15) of color look-up table RAM 230, the color value is output on the data bus and the n on the address bus. At the same time, write signal W1 is generated. This operation is performed during the non-display period of the CRT display where the address of color look-up table RAM 230 is set to the address bus of the microprocessor. Through this operation, the color value is written into the address n of color look-up table RAM 230. At the same time, the address bus is input to decoder 260, and the data is input to transparent detect circuit 240. Therefore, only the n-th decoder output is "1" in level, and the detection result appears at the output of transparency detect circuit 240. As described above, when the color value is R=B=G="0000", the output of transparency detect circuit 249 is "1". In other color values than the above, transparent detect circuit 240 is "0". The output of decoder 260 is input to AND gate group 261. Write signal W1 is input to the first input of each AND gate. 16 outputs of decoder 260 are input to the second inputs of AND gates. The output of AND gate group 261 is coupled with clock terminals CK of 16 flip-flops 262. The data inputs D of flip-flop group 262 are connected to the output of transparency circuit 240. With such an arrangement, the signal W1 is applied, as a clock signal, to only the n-th flip-flop, so that the transparency detection result is written into the address n of color look-up table RAM 230. Simultaneously, the color value indicating transparency is detected. The result is held in the n-th flip-flop of flip-flop group 262.

The read operation during the display period for the CRT display will now be described. 16 Q-outputs of flip-flop group 262 are input to the input terminals A0 top A15 of selector 263, respectively. One of those inputs is selected by four select signals S0 to S3, which come from frame memory 210, and the selected signal TR1 appears at the output terminal Q. The select signals S0 to S3 constitute the 4-bit data from frame memory 210. Therefore, it is possible to verify whether or not that data (entry address) from frame memory 210 represents "transparency".

Transparency decision signal TR1 output from selector 263, together with transparency decision signal TR2 which is similarly output from selector 266 for other frame, is supplied to frame select circuit 250. Frame select circuit 250 selects a display frame, and is designed so as to satisfy the following logical expressions:

$$S1=\overline{TR1} \quad (4)$$

$$S2=TR1.\overline{TR2} \quad (5)$$

By this circuit, only the output of the color look-up table for the selected frame is active. The outputs of the color look-up tables for other colors remain high in impedance. Thus, the primary color signals corresponding to the entry address are output from RAM 230 or 231 of the color look-up table for the selected frame.

According to the above-mentioned embodiment, the transparency decision result is obtained, with only the delay by selector 263, from the frame memory data. Therefore, the delay time up to the frame selection is considerably reduced. This feature eliminates the need for connection of timing synchronization latches, which otherwise would be required. Therefore, the display clock frequency range is increased. Further invention is applicable for the graphic terminal using a higher display clock frequency. Additionally, if the flip-flop group is preset by the power supply reset pulse, the "transparency" can be set up irrespective of the color value in the color look-up table. This eliminates the unpleasant random pattern which appears on the display screen when power is turned on. The "transparency" can automatically be removed if the color look-up table is set up.

According to the second embodiment, the transparency decision result is obtained with small delay time, while retaining a variety of colors for potential display. A remarkable reduction of the delay time up to the frame select therefore results. Accordingly, no latch is necessary for the timing synchronization, thereby widening the display clock frrequency range, and enabling application for terminals using high display clock frequency.

In the above-mentioned embodiment, a total of 12 bits are used for R, G and B component signals each consisting of 4 bits. If the number of bits for these components is further increased, the circuit scale reduction effect is further improved.

It should be understood that this invention is not limited to the Videoteks system, but is applicable for character teletext systems and personal computer systems.

What is claimed is:

1. An image frame composing circuit comprising:

first input means, for individually inputting the data of a plurality of image frames, the data of each frame representing entry addresses capable of causing a predetermined number of color designations including transparency designation;

second input means, for inputting color value data representing a plurality of primary color signals corresponding to the predetermined number of colors designated by said entry addresses;

a plurality of look-up table means for setting said color value data from said second input means in a predetermined address, addressable one by one, by said entry addresses from said first input means for each primary color, corresponding to said plurality of image frames;

transparency designation detect means for outputting a transparency designation signal when a predetermined value corresponding to said transparency designation is detected from said color value data from said second input means;

a plurality of transparency designation storing/read-out means for storing said transparency designation signal from said transparency designation detect means in the same address as that for said plurality of primary color signals to be set in said plurality of look-up table means, corresponding to said plurality of image frames, and for reading out the transparency designation signal stored, when the data of said plurality of image frames from said first input means correspondingly accesses an entry address corresponding to said transparency designation;

frame select means for outputtng a frame select signal, to select an image frame to be displayed for each pixel, according to said transparency designation signals read out from said plurality of transparency designation storing/read-out means and the display priorities order of said plurality of image frames from said first input means;

data select means for selecting an entry address, corresponding to said image frame to be displayed, from the data of said plurality of image frames from said first input means, according to said frame select signal from said frame select means, for accessing said plurality of look-up table means by means of the entry address selected, and for activating only the look-up table means corresponding to said image frame to be displayed according to said frame select signal from said frame select means; and data composing means for composing output signals from said plurality of look-up table means for each primary color, to output a plurality of primary color signals of said image frame to be activated and displayed.

2. The image frame composing circuit according to claim 1, further comprising a plurality of timing synchronization means, said timing synchronization means being connected to said image frame composing circuit for synchronizing the timing of a frame select signal produced by said frame select means with the timing of data of said plurality of image frames.

3. The image frame composing circuit according to claim 1, wherein said transparency detect means, said plurality of transparency designation storing/read-out means, said frame select means, and said data select means are fabricated into an integrated circuit, and outputs of said integrated circuit are said entry address selected corresponding to said image frame to be displayed from said data select means, and said frame select signal from said frame select means.

4. An image frame composing circuit comprising:

first input means, for individually inputting the data of a plurality of image frames, the data of each frame representing entry addresses capable of causing a predetermined number of color designations, including transparency designation;

second input means, for inputting color value data representing a plurality of primary color signals corresponding to the predetermined number of colors designated by said entry addresses;

a plurality of look-up table means for setting said color value data from said second input means in a predetermined address, addressable one by one, by said entry addresses from said first input means for each primary color, corresponding to said plurality of image frames;

transparency designation detect means for outputting a transparency designation signal when a predetermined value correspondng to said transparency designation is detected from said color value data from said second input means;

a plurality of flip-flop means whose number is equal to the numer of addresses of said plurality of look-up table means corresponding to said plurality of image frames, said transparency designation signal being set in the flip-flop means corresponding to the addresses of said plurality of primary color signals to be set in said plurality of look-up table means;

a plurality of output select means for respectively selecting an output signal from the flip-flop means in which said transparency designation signal is set, when the data of said plurality of image frames from said first input means accesses an entry address corresponding to said transparency designation;

frame select means for outputting a frame select signal dependent on output signals from said plurality of output select means, said frame select means selecting an image frame to be displayed for each pixel in accordance with said transparency designation signal and the order of display priorities of said plurality of image frames from said first input means;

data select means for individually accessing said plurality of look-up table means, by means of said entry address based on the data of said plurality of image frames from said first input means, and at the same time for activating only the look-up table means corresponding to said image frame to be displayed according to said frame select signal from said frame select means; and data composing means for composing output signals from said plurality of look-up table means for each primary color, and for outputting a plurality of primary color signals of said image frame, to be activated and displayed.

5. An image frame composing circuit comprising:

a plurality of color look-up tables provided corresponding to a plurality of image frames, said color look-up tables being used for converting entry addresses from said image frames into primary color signals as preset therein;

transparency designation decision means for checking whether or not the primary color signals set in said color look-up tables for each of said entry addresses are transparency designation signals;

a plurality of transparency designation storing means for respectively storing transparency designation signals output from said transparent designation decision means into the same addresses as those for the primary color signals set in said color look-up tables, in correspondence with the image frames, in a one-to-one corresponding manner;

frame select means for selecting a displayed image frame according to transparency designation signal outputs from said plurality of transparency designation storing means corresponding to said entry addresses and in the order of display priorities of the image frames;

entry address select means for selecting an entry address corresponding to the image frame selected by said frame select means from the entry addresses supplied to the image frames, and commonly supplying the entry address to said color look-up tables corresponding to the image frames; and image composing means for activating only one color look-up table, corresponding to the image frame selected by said frame select means of said color look-up tables, to which the entry address selected by said entry address select means is supplied, thereby to read out the primary color signals, and composing the image frames.

6. An image frame composing circuit comprising:

a plurality of color look-up tables provided corresponding to a plurality of image frames, said color look-up tables being used for converting entry addresses from said image frames into primary color signals as preset therein;

transparency detecting means for detecting whether or not transparency designation has been performed in relation to the primary color signals set in each of of appropriate addresses of said color look-up tables;

a plurality of flip-flop groups corresponding in number to that of addresses of each of said color look-up tables, a detect output from said transparency detecting means being set into each said flip-flop corresponding to an appropriate entry address;

a plurality of output means for respectively selecting an output from each one of the flip-flops corresponding to the entry addresses from said image frames;

frame select means for selecting a displayed image frame for each pixel according to a select output from said output select means and in the order of display priorities of said image frames, the output of said frame select means being coupled to said plurality of color look-up tables; and image frame composing means for reading out an activated output of only one color look-up table corresponding to the displayed image frame selected by said frame select means.

* * * * *